US006378751B1

(12) United States Patent
Ring

(10) Patent No.: US 6,378,751 B1
(45) Date of Patent: Apr. 30, 2002

(54) ACCUMULATOR SYSTEM FOR FOLDABLE SHEET-LIKE MATERIAL

(75) Inventor: Robert S. Ring, Rochester, NH (US)

(73) Assignee: Moore North America, Inc., Grand Island, NY (US)

( * ) Notice: Subject to any disclaimer, the term of this patent is extended or adjusted under 35 U.S.C. 154(b) by 87 days.

(21) Appl. No.: 09/639,770

(22) Filed: Aug. 15, 2000

(51) Int. Cl.[7] ..... B65H 20/30

(52) U.S. Cl. ..... 226/118.4; 493/413; 270/30.04

(58) Field of Search ..... 270/30.01, 30.04, 270/30.03, 30.11, 30.12, 30.13; 226/118.1, 118.5, 118.4; 242/417, 418.1; 493/413, 414, 415

(56) References Cited

U.S. PATENT DOCUMENTS

| | | | | |
|---|---|---|---|---|
| 2,826,479 A | * | 3/1958 | Cole | 226/118.4 |
| 3,123,268 A | * | 3/1964 | Gagg | 226/118.4 |
| 3,332,595 A | * | 7/1967 | Wetzler | 226/118.5 |
| 4,522,619 A | | 6/1985 | Bunch, Jr. | 493/415 |
| 4,561,581 A | * | 12/1985 | Kelly | 226/118.1 |
| 4,589,580 A | * | 5/1986 | Young et al. | 226/118.4 |
| 4,623,136 A | | 11/1986 | Bunch, Jr. | 270/1.1 |
| 4,820,250 A | | 4/1989 | Bunch, Jr. | 493/414 |
| 4,915,644 A | | 4/1990 | Bunch, Jr. | 493/357 |
| 4,917,657 A | | 4/1990 | Bunch, Jr. | 493/8 |
| 5,004,452 A | | 4/1991 | Bunch, Jr. | 493/414 |
| 5,015,222 A | | 5/1991 | Bunch, III | 493/11 |
| 5,024,644 A | | 6/1991 | Bunch, III | 493/357 |
| 5,049,121 A | | 9/1991 | Bunch, III | 493/357 |
| 5,104,366 A | | 4/1992 | Bunch | 493/23 |
| 5,234,146 A | * | 8/1993 | Meschi | 226/118.1 |
| 5,447,296 A | * | 9/1995 | Cox | 226/118.4 |

FOREIGN PATENT DOCUMENTS

| | | | |
|---|---|---|---|
| JP | 5-238613 | * | 9/1993 |

* cited by examiner

*Primary Examiner*—Christopher P. Ellis
*Assistant Examiner*—Patrick Mackey
(74) *Attorney, Agent, or Firm*—Hodgson Russ LLP

(57) ABSTRACT

An accumulator system for foldable sheet-like material. The system includes an accumulator bin having a pair of sidewalls, a pair of end walls, a bottom wall, and an open top. An infeed mechanism conveys the material to the accumulator bin. A chute receives the material from the infeed mechanism and guides the material inside the chute. In a first state, the chute is stationary and the system operates in a steady-state condition with a loop in the material between the infeed mechanism and an outfeed mechanism. In a second state, the outfeed mechanism is shut off and the chute is capable of reciprocating such that the material is guided toward the bottom wall of the bin. The reciprocating motion of the chute causes the material to be folded endwise in alternating fashion.

20 Claims, 2 Drawing Sheets

ACCUMULATOR SYSTEM FOR FOLDABLE SHEET-LIKE MATERIAL

FIELD OF INVENTION

The present invention pertains generally to material handling equipment for conveying sheet-like materials and particularly to a system for conveying a paper web for printing, slitting, and cutting.

BACKGROUND OF THE INVENTION

In the production of preprinted business forms it is known to feed a web from a printer through an accumulator. The web is fed over an infeed roll into an accumulator bin where, during steady-state operation of the system, a loop is formed inside the accumulator bin between the infeed mechanism and an outfeed mechanism. The loop serves many functions including removing the "belt" tension from the outfeed mechanism.

Downstream from the outfeed device, a cutter cuts and stacks the printed forms. For some cutting operations, it is necessary to periodically remove a stack of cut forms from the cutter. In order to do so, the cutter and the outfeed device may have to be temporarily shut down. When the cutter stops, the outfeed device also must stop feeding material from the accumulator. During the stoppage it is preferable for the infeed device to continue to convey material such that the web is continuously fed into the accumulator bin. At this point, the web is still attached to the outfeed device but the portion between the outfeed device and the infeed device is uncontrolled as it enters the accumulator bin. Accordingly, the web piles up in the accumulator bin relatively randomly with cross-folding and wrinkling sometimes occurring.

When the cutter comes back on line, the accumulator outfeed device pulls the web out of the accumulator bin from the bottom of the pile. If the web has cross-folded or wrinkled, there could be a jam in the outfeed device or in the cutter downstream of the accumulator bin.

Accordingly, there is a need for a material handling device that prevents the web from cross-folding or wrinkling during the period when the outfeed device is shut off and the web is accumulating in the accumulator bin.

SUMMARY OF THE INVENTION

The present invention meets the above-described need by providing an accumulator system for foldable sheet-like material. The system includes an accumulator bin having a pair of sidewalls, a pair of end walls, a bottom wall, and an open top. An infeed mechanism conveys the material to the accumulator bin. A chute receives the material from the infeed mechanism and guides the material inside the chute. The chute is capable of reciprocating such that the material is guided toward opposite sides of the bottom wall of the bin. The reciprocating motion of the chute causes the material to be folded endwise in alternating fashion. An outfeed mechanism conveys the material to a downstream device such as a cutter. Some downstream cutting operations require an intermittent shut down for removing materials from the cutting station.

The present invention accommodates the downstream flow stoppage by providing for two modes of operation. In a first steady-state condition, the reciprocating chute is stationary and the infeed mechanism and outfeed mechanism form a loop of material in the accumulator bin and convey the material through the system to the downstream device. In a second condition, the outfeed mechanism stops conveying material, and the infeed mechanism continues to convey. The excess material conveyed by the infeed mechanism is folded in the accumulator bin by the reciprocating motion of the reciprocating chute until the outfeed mechanism restarts. Next, the outfeed mechanism pulls material from the bottom of the stack until the loop is formed in the accumulator bin again.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

Figure 1:
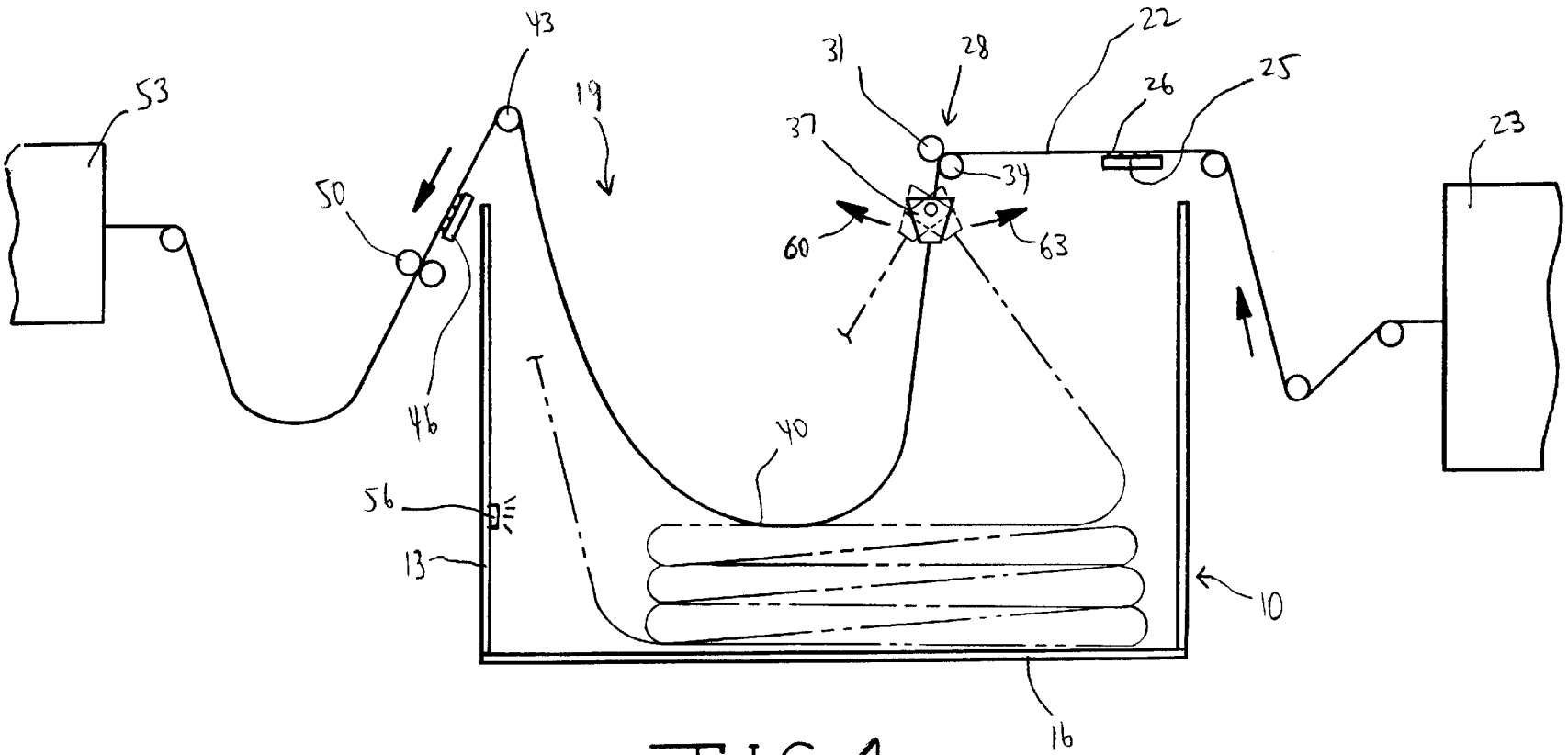
FIG. 1 is a schematic of the accumulator system of the present invention; and, FIG. 2 is an enlarged perspective view of the reciprocating chute of the present invention.

Referring to drawings 1–2, and initially referring to FIG. 1, an accumulator bin 10 preferably comprises a pair of end walls 13, a pair of side walls (not shown), a bottom wall 16, and an open top 19. A web 22 of flat, foldable material such as paper travels from right to left with respect to the orientation of FIG. 1. The web 22 may comprise paper from a printer 23. The web 22 may include a series of apertures (not shown) located along the periphery of each side of the web 22. The apertures are sized to be capable of engaging with a tractor feed mechanism, as known to those of ordinary skill in the art. The web 22 enters infeed mechanism 25 which preferably comprises a positive-traction type tractor feed device. The infeed mechanism 25 includes a plurality of fingers 26 that engage with the apertures in the web 22 to convey the web 22 along the path defined by the mechanism 25. The web 22 is preferably conveyed continuously by the operation of mechanism 25.

The mechanism 25 conveys the web 22 to a bearing 28 which preferably comprises three nip rollers 31 and a roller 34 that form a nip. The rollers 31, 34 are preferably low friction rollers. Roller 34 is driven and rollers 31 are idlers. After the web 22 exits the rollers 31, 34, the web 22 enters the center of a chute 37 that is disposed above the accumulator bin 10. From the chute 37, the web 22 extends downward into the accumulator bin 10 to form a loop 40, as indicated by the solid line in FIG. 1.

From the bottom of the loop 40 the web 22 travels over an auxiliary roller 43 and enters an outfeed mechanism 46. The outfeed mechanism 46 is preferably a positive-traction tractor feed device, as known to those of ordinary skill in the art. In the case of a sheet-like material such as paper with apertures along each edge, a tractor feed with fingers for engaging the apertures in the paper provides a suitable conveying method. Other sheet-like materials may be conveyed by different devices with different characteristics as known to those of ordinary skill in the art.

Downstream from the outfeed mechanism 46, the web 22 may be processed by a slitting station 50 and a cutting station 53. Typically the slitting station 50 trims the edges of the web 22, and the cutting station 53 cuts the web 22 into individual lengths.

As indicated by the solid line in FIG. 1, the steady-state condition for the system includes a loop 40 of material disposed between the infeed and the outfeed mechanisms 25, 46. A sensor 56 mounted on the accumulator bin 10 may take the form of an electric eye that is capable of detecting the presence of material. As known to those of ordinary skill in the art, the beam may be blocked when material is accumulated in the bottom of the accumulator bin 10 or when material is hanging in a loop 40 below a certain height in the bin 10. When the outfeed mechanism 46 pulls material from the bin 10 at too fast a rate, the loop 40 will start to move toward the top 19 of the bin 10 and the sensor 56 will detect the absence of material. At this point, the information from the sensor 56 can be used to control the speed of the outfeed mechanism 46 through a variable speed drive (not shown) to slow down the outfeed mechanism 46. Other drive controls and sensor systems may also be suitable for establishing the loop 40, as known to those of ordinary skill in the art.

When the outfeed mechanism 46 stops conveying material, the accumulator bin 10 provides a storage area for the excess material from the web 22 that is conveyed by the infeed mechanism 25. Also, when the outfeed mechanism 46 stops, the reciprocating chute 37 begins to reciprocate as indicated by the arrows 60 and 63. The motion of the reciprocating chute 37 causes the web 22 to fold endwise along the bottom of the bin 10 in alternating fashion, as indicated by the phantom lines. The web 22 continues to fold in this manner until the outfeed mechanism 46 starts to convey the web 22 again. A time limit based on the output speed of the printer 23 is used to limit the amount of the web accumulation in the bottom of the bin 10 before the printer 23 is shut down.

Figure 2:
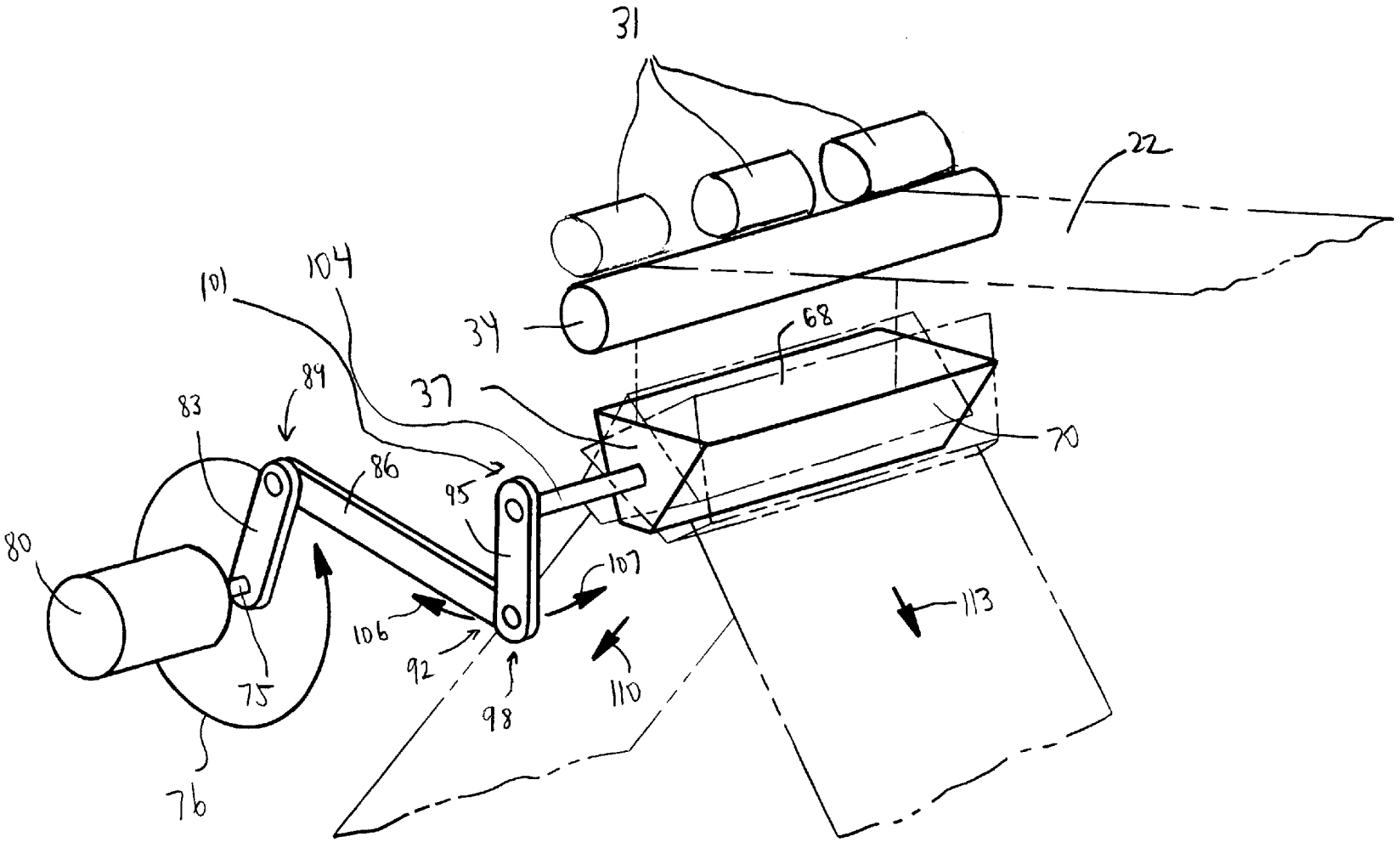

Turning to FIG. 2, the reciprocating chute 37 receives the web 22 through the center of a pair of side walls 68, 70. The reciprocating chute 37 is disposed below the set of rollers 31, 34. The chute 37 reciprocates by means of a mechanical linkage which includes a rotating drive shaft 75 controlled by a motor 80. A drive (not shown) is connected to a driver link 83. The shaft 75 rotates in the direction of arrow 76. The driver link 83 is pivotally attached to a connecting link 86 at a first end 89. At the opposite end 92 of the connecting link 86, the connecting link 86 is pivotally connected to a follower link 95 at a first end 98 of the follower link 95. At the opposite end 101 of the follower link 95, the follower link 95 is fixedly attached to a shaft 104 connected to the chute 37. When the drive shaft 75 rotates, the motion of the driver link 83 transmitted through the linkage causes the chute 37 to rotate back and forth through its connection to the follower link 95. The rotation of the reciprocating chute 37 indicated by arrows 106, 107 is designed to guide the web 22 down toward one side or the other side of the bin 10, as indicated by arrows 110, 113. When the chute 37 reverses direction, the web 22 is folded endwise and then guided toward the opposite side of the accumulator bin 10. Once the web 22 reaches the other side, the reciprocating chute 37 reverses direction and the web 22 is folded in the opposite direction, as indicated by the phantom lines in FIG. 1. Other mechanical designs for providing reciprocating motion of the chute 37 such as rotating cranks formed by a link arm attached to a wheel at a position offset from the center of the wheel and the like would also be suitable, as known to those of ordinary skill in the art.

Returning to FIG. 1, in steady-state operation, the web 22 is conveyed from an upstream printer 23 through the infeed mechanism 25 into a downward loop 40 inside the accumulator bin 10 to an outfeed mechanism 46 and the downstream slitting and cutting devices 50, 53. When the outfeed mechanism 46 is taken off-line, the chute 37 begins to reciprocate and the infeed mechanism 25 continues to convey the material into the accumulator bin 10, as shown in the phantom lines.

The above-described invention provides several advantages including control of the web 22 during the time when the outfeed mechanism 46 is off line. The reciprocating chute 37 provides for folding of the web 22 inside the accumulator bin 10 to avoid misfeeding problems associated with cross-fold and wrinkling of the web 22.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. An accumulator system for foldable sheet-like material, comprising:

an accumulator bin having a pair of sidewalls, a pair of end walls, a bottom wall, and an open top;

an infeed mechanism capable of conveying the material to the accumulator bin;

a reciprocating chute capable of receiving the material from the infeed mechanism and guiding the material inside the chute, the chute capable of reciprocating such that the material is guided toward the bottom wall of the bin so that the material is folded endwise in alternating fashion; and, an outfeed mechanism capable of conveying the material to a downstream device; and, wherein the system alternates between a first steady-state condition where the reciprocating chute is stationary and the infeed mechanism and outfeed mechanism convey the material through the system to the downstream device and a second condition where the outfeed mechanism stops, the chute reciprocates, and the infeed mechanism continues to convey material so that the material is folded in the accumulator bin by the reciprocating motion of the reciprocating chute until the outfeed mechanism restarts.

2. The accumulator system of claim 1, further comprising at least one bearing disposed above the accumulator bin such that material from the infeed mechanism passes over the bearing and into the reciprocating chute.

3. The accumulator system of claim 1, wherein the infeed mechanism is a positive traction device.

4. The accumulator system of claim 1, further comprising a first sensor mounted on the accumulator bin, the sensor capable of detecting the presence of the material.

5. The accumulator system of claim 4, further comprising a variable speed first drive operatively associated with the outfeed mechanism, the drive capable of adjusting the speed of the outfeed mechanism based on input from the sensor such that a loop of material between the infeed mechanism and the outfeed mechanism is maintained inside the accumulator bin.

6. The accumulator system of claim 1, wherein the system shuts down the infeed mechanism based on a time limit based on an output speed of the infeed mechanism.

7. The accumulator system of claim 6, wherein a second drive for controlling the infeed mechanism is controlled such that when the time limit is reached the infeed mechanism is shut off to prevent overfilling of the accumulator bin.

8. The accumulator system of claim 1, wherein the downstream device comprises a cutter.

9. An accumulator system for conveying foldable sheet-like material, comprising:

an accumulator bin having a pair of side walls, an end wall, a bottom wall and an open top;

a loop sensor mounted on the accumulator bin;

an infeed mechanism capable of conveying the material to the accumulator bin;

at least one bearing disposed above the accumulator bin and defining a conveying path for the material;

a reciprocating chute capable of receiving the sheet material after it exits the at least one bearing, the chute capable of reciprocating with the material disposed there through such that the material is guided toward the bottom wall of the accumulator bin so that the material is folded endwise in alternating fashion; and, an outfeed mechanism capable of conveying the material to a non-continuous downstream device;

a variable speed drive control system for the outfeed mechanism capable of adjusting the speed of the outfeed mechanism in response to the loop sensor;

wherein the system alternates between a first steady-state condition having the reciprocating chute stationary with the infeed mechanism and the outfeed mechanism cooperating to convey the material through the system at a steady rate to the downstream device, and a second condition where the outfeed mechanism stops, the chute reciprocates, and the infeed mechanism continues to convey material so that the material is folded in the accumulator bin by the reciprocating motion of the reciprocating chute until the outfeed mechanism restarts.

10. The accumulator system of claim 9, wherein the downstream device is a cutter.

11. The accumulator system of claim 9, wherein the infeed mechanism is a positive traction device.

12. The accumulator system of claim 9, wherein the at least one bearing comprises a pair of rollers forming a nip.

13. The accumulator system of claim 9, wherein the reciprocating chute is driven by a rotating shaft through a linkage.

14. The accumulator system of claim 13, wherein the linkage comprises a follower link, a driver link and a connecting link.

15. The accumulator system of claim 9, wherein the system shuts down the infeed mechanism based on a time limit based on an output speed of the infeed mechanism.

16. The accumulator system of claim 15, wherein a second drive for controlling the infeed mechanism is controlled such that when the time limit is reached the infeed mechanism is shut off to prevent overfilling of the accumulator bin.

17. A method for accumulating a foldable sheet-like material, the method comprising the steps of:

conveying the material through a chute disposed above an accumulator bin having a bottom wall, the material being conveyed from an infeed mechanism to an outfeed mechanism, the material being conveyed such that a loop of material is maintained in the accumulator bin between the infeed mechanism and the outfeed mechanism;

stopping the outfeed mechanism;

reciprocating the chute while continuing to convey material through the infeed mechanism such that the incoming material is guided to the bottom wall of the accumulator bin such that the material is folded endwise in alternating fashion;

starting the outfeed mechanism such that material is conveyed from the bottom of the accumulator bin until the loop inside the accumulator bin is formed; and, holding the reciprocating chute stationary until the outfeed mechanism stops again.

18. The method of claim 17, wherein the downstream device is a cutter.

19. The method of claim 17, further comprising the step of conveying the material over a bearing device located between the infeed mechanism and the chute.

20. The method of claim 19, wherein the bearing device comprises a pair of rollers forming a nip.

* * * * *